US007768443B2

(12) United States Patent
Imazu et al.

(10) Patent No.: US 7,768,443 B2
(45) Date of Patent: Aug. 3, 2010

(54) VESSEL MONITORING SYSTEM

(75) Inventors: Hayama Imazu, Tokyo (JP); Akio Akamatsu, Nishinomiya (JP); Takashi Yoshioka, Nishinomiya (JP); Hisaichi Ohshima, Nishinomiya (JP); Yoshiyuki Kiya, Nishinomiya (JP); Takumi Kawamoto, Nishinomiya (JP)

(73) Assignee: Furuno Electric Company Limited, Nishinomiya-shi (JP)

( * ) Notice: Subject to any disclaimer, the term of this patent is extended or adjusted under 35 U.S.C. 154(b) by 305 days.

(21) Appl. No.: 11/547,582

(22) PCT Filed: Apr. 1, 2005

(86) PCT No.: PCT/JP2005/006974

§ 371 (c)(1),
(2), (4) Date: Aug. 31, 2009

(87) PCT Pub. No.: WO2005/095200

PCT Pub. Date: Oct. 13, 2005

(65) Prior Publication Data

US 2009/0315756 A1 Dec. 24, 2009

(30) Foreign Application Priority Data

Apr. 2, 2004 (JP) ..... 2004-110178

(51) Int. Cl.
*G01S 13/93* (2006.01)

(52) U.S. Cl. ..... 342/41; 342/95; 342/176; 342/179; 340/984; 701/21

(58) Field of Classification Search ..... 342/41, 342/55–58, 90, 95–97, 176, 185; 340/984; 701/21

See application file for complete search history.

(56) References Cited

U.S. PATENT DOCUMENTS 4,104,629 A * 8/1978 Isbister et al. ..... 342/43
4,833,475 A * 5/1989 Pease et al. ..... 342/185
4,845,501 A * 7/1989 Pease et al. ..... 342/185
5,450,329 A * 9/1995 Tanner ..... 701/213

(Continued)

FOREIGN PATENT DOCUMENTS

GB 2338855 A * 12/1999

(Continued)

OTHER PUBLICATIONS

Wawruch, R.; , "Quality of information about tracked vessel in VTS centre," Electronics in Marine, 2004. Proceedings Elmar 2004. 46th International Symposium , vol., No., pp. 95-100, Jun. 16-18, 2004 URL: http://ieeexplore.ieee.org/stamp/stamp.jsp?tp=&arnumber=1356357&isnumber=29769.*

(Continued)

*Primary Examiner*—John B Sotomayor
(74) *Attorney, Agent, or Firm*—Nutter McClennen & Fish LLP; John J. Penny, Jr.

(57) ABSTRACT

The vessel monitoring system has, in a trial navigation by provisionally setting a value of the speed of the own vessel arbitrarily, a display unit immediately display an Obstacle Zone by Targets (OZT) corresponding to the speed of the own vessel.

The vessel monitoring system includes a calculator for calculating an Obstacle Zone by Targets, a display unit for displaying the Obstacle Zone by Targets obtained by the calculation by the calculator, and an integrated controller for processing trial navigation that integrally controls mutually cooperated processing of calculation by the calculator and display by the display unit, in a trial navigation by provisionally setting a value of the speed of the own vessel arbitrarily, so that the calculator calculates an Obstacle Zone by Targets corresponding to the arbitrarily and provisionally set value of the speed of the own vessel, and the display unit displays the result of the calculation.

12 Claims, 7 Drawing Sheets

U.S. PATENT DOCUMENTS

| | | | | |
|---|---|---|---|---|
| 6,904,341 | B2 * | 6/2005 | Kish et al. | 701/21 |
| 2003/0112171 | A1 * | 6/2003 | Michaelson et al. | 342/41 |
| 2009/0315756 | A1 * | 12/2009 | Imazu et al. | 342/41 |

FOREIGN PATENT DOCUMENTS

| | | | |
|---|---|---|---|
| JP | 04363689 | A * | 12/1992 |
| JP | 10160823 | A * | 6/1998 |
| JP | 2007286725 | A * | 11/2007 |

OTHER PUBLICATIONS

Burns, R.S.; , "The use of artificial neural networks for the intelligent optimal control of surface ships," Oceanic Engineering, IEEE Journal of , vol. 20, No. 1, pp. 65-72, Jan. 1995 URL: http://ieeexplore.ieee.org/stamp/stamp.jsp?tp=&arnumber=380245&isnumber=8634.*

* cited by examiner

VESSEL MONITORING SYSTEM

TECHNICAL FIELD

The present invention relates to a vessel monitoring system configured to have a calculator to calculate an Obstacle Zone by Targets (OZT) corresponding to a speed of an own vessel when provisionally setting the speed of the own vessel to a given value, and to have a display unit to display the result of the calculation.

BACKGROUND ART

As devices used to recognize vessels on the water, there have been conventionally known a radar detection system using radar and equipped on an own vessel and an Automatic Identification System based on information transmitted from target vessels in addition to visual monitoring by a person on the bridge.

When using the visual monitoring, the person on the bridge acquires a target vessel in three dimensions, and sensuously recognizes relative position information of the target vessel based on the direction and distance of the target vessel from the own vessel. However, when the target vessel is located far away, the person on the bridge may not correctly acquire the depth, i.e. the distance between the own and target vessels. When using radar, it is possible to acquire the relative position information of the target vessel based on the direction and distance of the target vessel from the own vessel with markedly higher accuracy in comparison with the above visual monitoring of the relative position information. However, due to the characteristics of the radar waves, it may not possible in some cases to acquire a target vessel with an insufficient reflection intensity of the radar waves. Further, when using the Automatic Identification System, the relative position information of the target vessel based on the direction and distance of from the own vessel depends on the type and reliability of information transmitted from the target vessel.

On the other hand, when taking update frequency of the information relating to the target vessel into account, while the visual information appears to be collected continuously by the person on the bridge, the collection of visual information is only continuous for a particular vessel to which the person on the bridge pays attention, and the visual information on other target vessels is updated at undetermined interval. In addition, when using radar, the interval of the information update depends on a rotation speed of a radar antenna. Furthermore, when using the Automatic Identification System, provided that the target vessel transmits information at a predetermined update interval in accordance with regulation, the interval of update varies significantly depending on the speed and the state of the target vessel, from the vessel on the berth to the vessel under way on fast track.

As described above, various relative position identifying devices such as the visual organ as the device for identifying a relational position of a target vessel represented by the direction and distance from the own vessel, the radar, and the Automatic Identification System, provide information with different range and quality at a different update interval depending on the type of the relative position identifying device. Therefore, when attempting to collect the relative position information of the target vessel using these devices separately and simultaneously, the person on the bridge may encounter a situation in which it is not possible to immediately determine which piece of relative position information acquired by one identification device for one target vessel corresponds to a piece of relative position information acquired by a different identification device for the target vessel. In particular, in a situation in which there are a number of vessels densely under way within a visual field of the person on the bridge, it becomes even more difficult to determine if the target vessel acquired by one identification device is the same vessel as the one acquired by another identification device. This poses a very serious problem in view of ensuring the secure navigation of vessels (see Patent Document 1).

[Patent Document 1]

Japanese Patent Application No. 2003-289764

An object of the present invention is to provide a vessel monitoring system that has a display unit to display an Obstacle Zone by Targets, based on a course and a speed of a target vessel and a course and a speed of an own vessel, in a case in which the course of the own vessel is changed to an arbitrary direction, the Obstacle Zone by Targets indicating a region of locations where the own vessel may reach at the same time as the target vessel with equal to or more than a predetermined probability, and, in a trial navigation by provisionally setting a value of the speed of the own vessel arbitrarily, immediately display an OZT corresponding to the arbitrarily and provisionally set value of the speed of the own vessel.

DISCLOSURE OF THE INVENTION

A vessel monitoring system according to the present invention includes: a calculator for calculating an Obstacle Zone by Targets, based on a course and a speed of a target vessel and a course and a speed of an own vessel, for a case in which the course of the own vessel is changed to an arbitrary direction, the Obstacle Zone by Targets indicating a region which the own vessel reaches the same location at the same time as the target vessel with equal to or more than a predetermined probability; a display unit for displaying positional relation between the own vessel and the target vessel, as well as the Obstacle Zone by Targets obtained by the calculation by the calculator; and an integrated controller for processing trial navigation that, in a trial navigation by provisionally setting a value of the speed of the own vessel arbitrarily, integrally controls mutually cooperated processing of the calculation by the calculator and the display by the display unit, so that the calculator calculates the Obstacle Zone by Targets corresponding to the arbitrarily and provisionally set value of the speed of the own vessel, and the display unit displays the result.

In addition, in the vessel monitoring system according to the present invention, the display unit is configured to selectively display an Obstacle Zone by Targets relating to a specified target vessel.

Further, in the vessel monitoring system according to the present invention, the display unit is configured to display in direction-distance coordinates in which a horizontal axis is relative direction based on the heading of the own vessel, and a vertical axis is direct distance from the own vessel.

Further, in the vessel monitoring system according to the present invention, the display unit is configured to display so that a horizontal axis is relative direction based on the heading of the own vessel, a first vertical axis is direct distance from the own vessel, a second vertical axis is time obtained from the distance from the own vessel divided by a value of the arbitrarily set speed of the own vessel, and a scale varies according to the value of the speed of the own vessel every time the speed of the own vessel is set again.

Further in the vessel monitoring system according to the present invention, the display unit is configured to display in absolute coordinates based on the Mercator projection including the course of the own vessel.

Further, in the vessel monitoring system according to the present invention, the display unit is configured to display in absolute coordinates based on the zenithal projection including the course of the own vessel.

Further, in the vessel monitoring system according to the present invention, the display unit is configured to display based on the zenithal projection arbitrarily selected from: the zenithal projection with north-up where the coordinate axes are fixed centering the own vessel with the North Pole upside, the zenithal projection with course-up where the coordinate axes are fixed centering the own vessel with the bearing of the own vessel upside, and the zenithal projection with heading-up where the coordinate axes are fixed centering the own vessel with the arbitrarily set heading of the own vessel upside.

Further, in the vessel monitoring system according to the present invention, the display unit is configured to display an expected course line indicating an expected course extended from a current position of the target vessel, thereby allowing immediate identification of correspondence between an encounter position and the target vessel which the own vessel is to encounter at the encounter position.

Further, in the vessel monitoring system according to the present invention, the display unit is configured to display the display screen overlaid with a radar image of the own vessel after coordinate transformation so that the coordinates of the radar image match the coordinates in the display unit.

Further, in the vessel monitoring system according to the present invention, the display unit is capable of displaying the display screen overlaid with a watch and alarm area, a position and a range thereof being set arbitrarily, and the display unit includes an alarm generation unit that immediately generates an alarm, when at least one of the radar image and the OZT overlaps with the watch and alarm area.

Further, in the vessel monitoring system according to the present invention, when a target vessel is selectively specified according to a screen operation, the calculator calculates and specifies a position at which the own vessel reaches at the same time as the specified target vessel with a highest probability, and the display unit displays a shortest distance to and a direction of the position specified by the calculator from the own vessel.

Further, in the vessel monitoring system according to the present invention, the display unit is configured to display by identifying Obstacle Zones by Targets according to degrees of the probability that the own vessel reaches the same location at the same time as the target vessel.

According to the vessel monitoring system of the present invention, the following effects may be achieved.

In a trial navigation by provisionally setting a course and a value of a speed of an own vessel arbitrarily, a display unit is configured to display an OZT corresponding to the arbitrarily and provisionally set course and value of the speed of the own vessel. Therefore, with a trial navigation by provisionally setting a course and a value of a speed of the own vessel arbitrarily, it is possible to prevent the own vessel from interfering a target vessel promptly without fail, as well as to approach a desired target vessel in the shortest time by the most suitable course and most suitable speed.

BEST MODE FOR CARRYING OUT THE INVENTION

Figure 1:
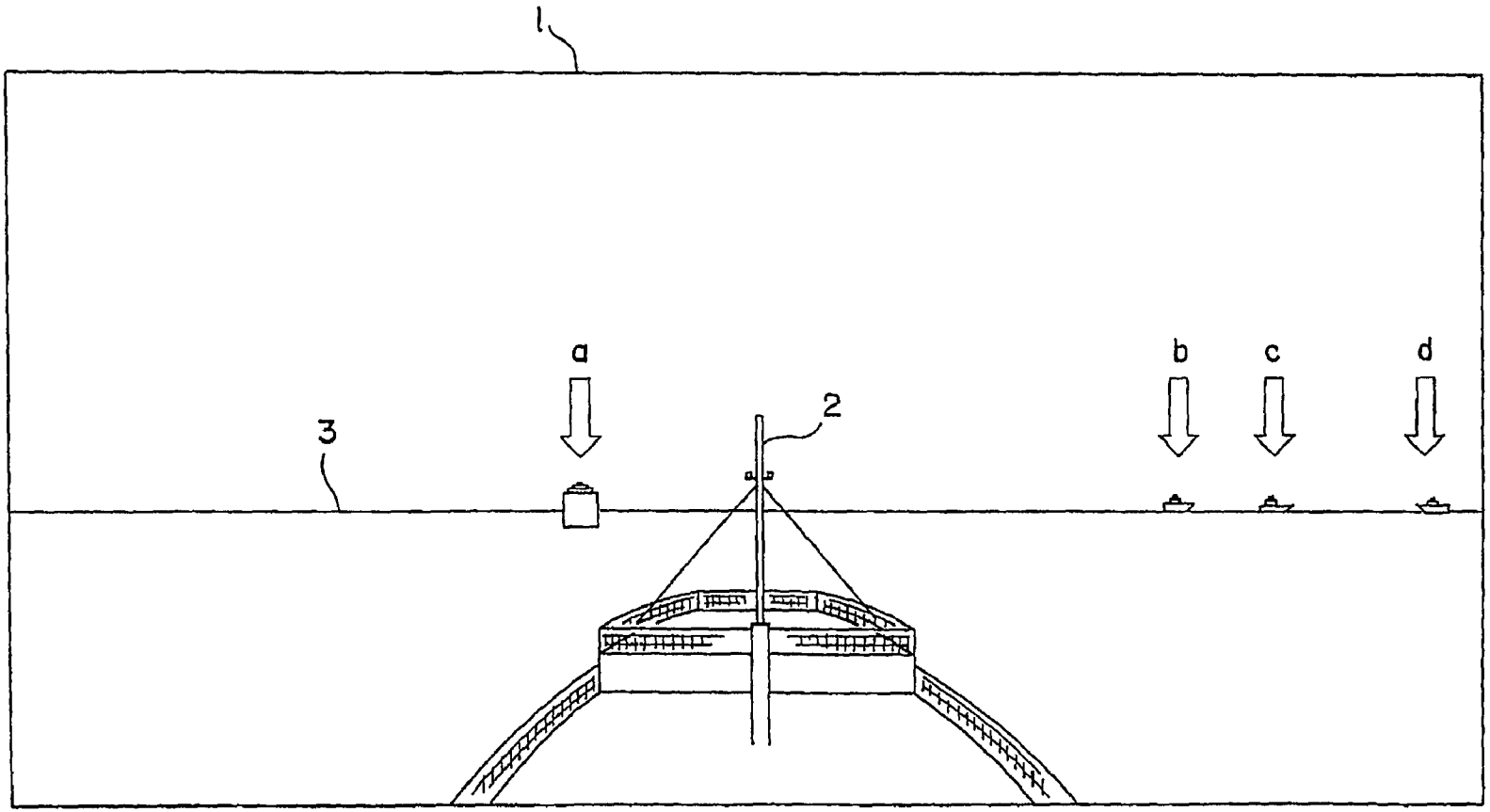
FIG. 1 illustrates an explanatory display screen displaying an example of landscape on the water viewed from an own vessel that is virtually reproduced.
Figure 2:
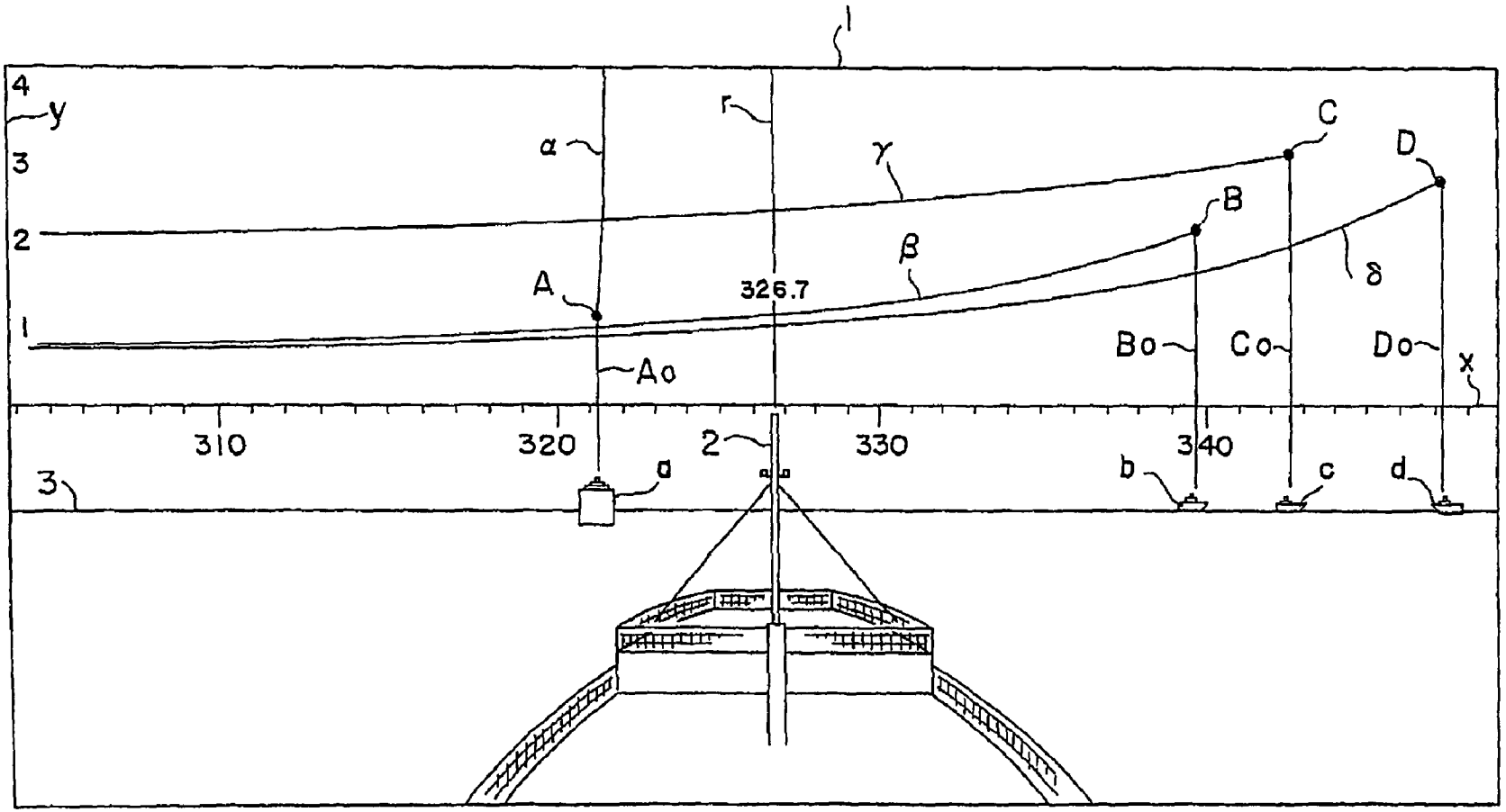
FIG. 2 illustrates an example of the display screen of FIG. 1 overlaid with, according to the present invention, a direction-distance coordinate, a radar image after coordinate transformation, and a positional image, which is produced after coordinate transformation, of positional information of target vessels acquired by an Automatic Identification System.
Figure 3:
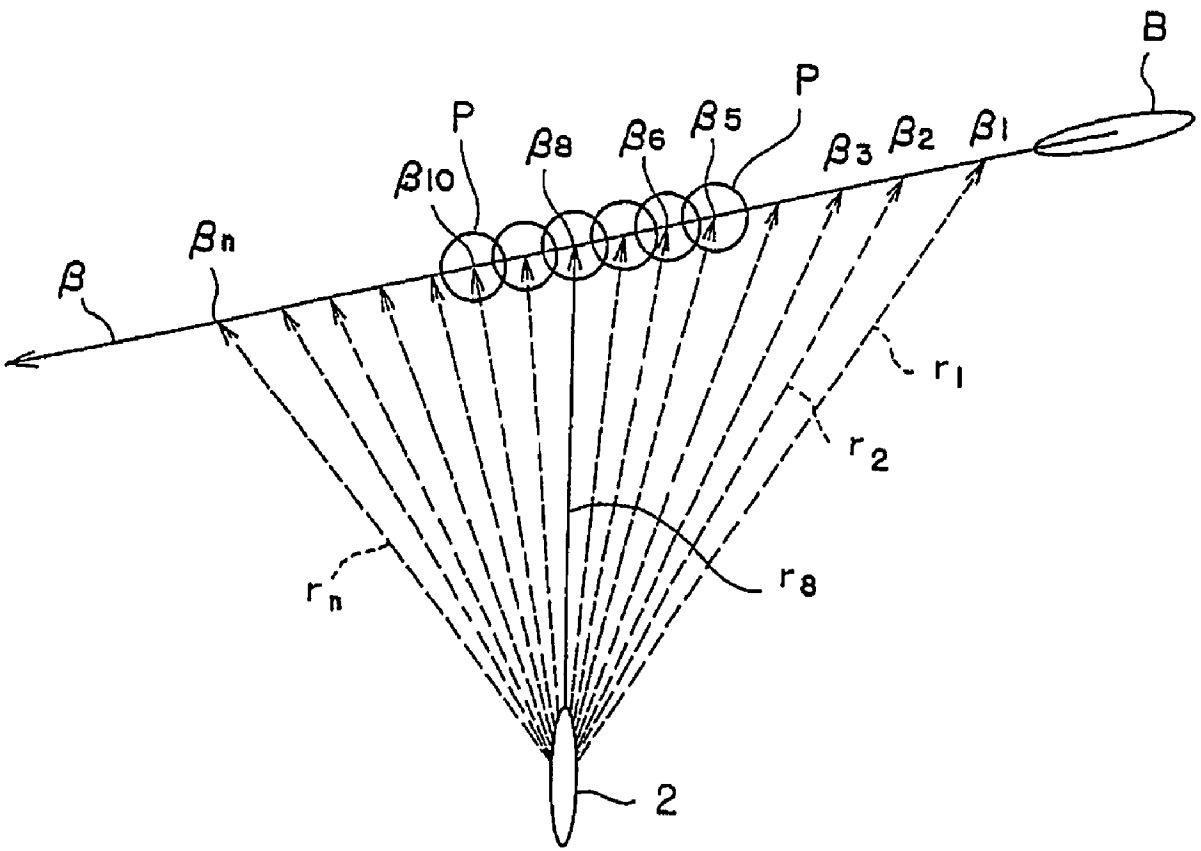
FIG. 3 illustrates a view for explaining the basic idea of an Obstacle Zone by Targets (OZT) according to the present invention.
Figure 4:
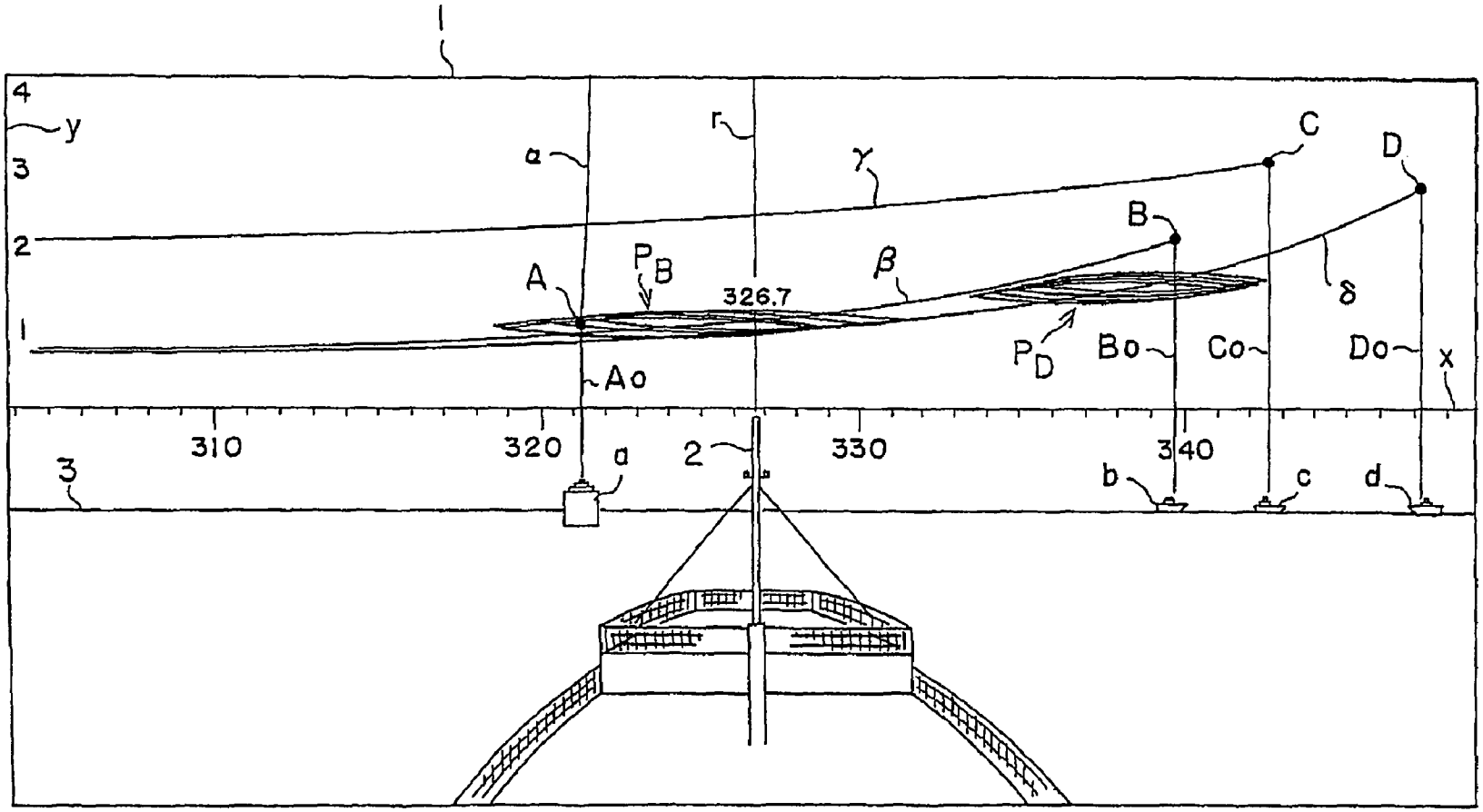
FIG. 4 illustrates an example of the display screen of FIG. 2 overlaid with the OZT after coordinate transformation according to the present invention.

The following describes an embodiment of the present invention with reference to the drawings. FIG. 1 illustrates an explanatory display screen displaying an example of landscape on the water viewed from an own vessel that is virtually reproduced. FIG. 2 illustrates the display screen of FIG. 1 overlaid with, according to the present invention, a direction-distance coordinate, a radar image after coordinate transformation, and a positional image, which is produced after coordinate transformation, of positional information of target vessels acquired by an Automatic Identification System. FIG. 3 illustrates a view for explaining the basic idea of an Obstacle Zone by Targets (OZT) according to the present invention. FIG. 4 illustrates an example of the display screen of FIG. 2 overlaid with the OZT after coordinate transformation according to the present invention.

First, referring to FIG. 1, a display screen 1 of a navigation aid system according to the present invention displays an explanatory example of landscape on the water viewed from an own vessel 2 that is virtually reproduced in the display screen. In the display screen 1 of FIG. 1, a horizon 3 is seen in front of the own vessel 2, and an image a of another vessel, that is, a target vessel, is displayed in left fore of a bow, in addition to images b, c, and d of different target vessels displayed in right fore of the bow.

As shown in FIG. 2, the display screen 1 is provided with a horizontal axis x, along which a graduation is shown to indicate directions in the landscape seen from the own vessel 2, for example, 310 degrees, 320 degrees, 330 degrees, and 340 degrees. From this graduation, it can be seen that the heading of a course r of the own vessel 2 is 326.7 degrees in FIG. 2.

In FIG. 2, a vertical axis y is provided that is perpendicular to the horizontal axis x of the display screen 1 in an upward direction. The vertical axis y is set along left side edge of the display screen 1 in FIG. 2. Shown along the vertical axis y is a graduation indicating distances from the own vessel, for example, 1 nautical mile, 2 nautical miles, 3 nautical miles, and 4 nautical miles. In this way, a direction-distance coordinate plane is set on the display screen 1 by the horizontal axis x and the vertical axis y.

As shown in FIG. 2, the target vessels acquired by radar and the target vessels acquired by the Automatic Identification System (AIS) are shown by such marks as target vessel position indication marks A, B, C, and D, for example, on the direction-distance coordinate plane on the display screen 1. The figure of the target vessel position indication marks A. B, C, and D may be any shape as long as the positions of the target vessels on the direction-distance coordinate plane can be clearly identified. For example, the target vessel position indication marks may be a filled circle as shown in the drawing, a double circle, or any other figure that is easily identified.

In addition, in FIG. 2, a position indication mark of a target vessel acquired by radar but not by the Automatic Identification System, a position indication mark of a target vessel acquired by both radar and the Automatic Identification System, and a position indication mark of a target vessel acquired by the Automatic Identification System but not by radar may be displayed by figures of different shapes, or different colors. By this, it is possible to immediately determine if a target vessel is acquired by radar or by the Automatic Identification System.

The navigation aid system shown in FIG. 2 may display vertical lines A0, B0, C0, and D0 drawn from the position indication marks A, B, C, and D of the target vessels displayed on the direction-distance coordinate plane of the display screen 1 to the horizontal axis x of the direction-distance coordinate plane on the direction-distance coordinate plane of the display screen 1, so that it is possible to determine corresponding positions on the horizontal axis x of the position indication marks A, B, C, and D of the target vessels respectively acquired by at least one of the radar and the Automatic Identification System without fail, so that the respective target vessels may be identified.

As shown in FIG. 2, the display screen 1 displays, overlaid on the direction-distance coordinate plane of the display screen 1, expected routes α, β, γ, and δ of the respective target vessels respectively represented by the position indication marks A, B, C, and D on the direction-distance coordinate plane provided that the target vessels each maintain the current courses and speeds. The expected routes α, β, γ, and δ originate from the position indication marks A, B, C, and D, respectively. Further, an expected route r of the own vessel 2, in a case in which the own vessel 2 maintains the current course, is displayed at the center of the display screen 1.

In FIG. 2, each of the expected routes α, β, γ, δ, and r may be selectively displayed overlaid with the direction-distance coordinate plane of the display screen 1, individually or simultaneously, according to a screen operation. With this, it is possible to immediately read, for example, that the target vessel represented by the position indication mark A is under way along the expected route α to the direction generally the same as the heading of the own vessel 2 on the direction-distance coordinate plane. It is also possible to immediately read that the target vessels represented by the position indication marks B, C, and D are under way along the expected route β, γ, and δ so as to cross the course of the own vessel 2 from right to left ahead of the own vessel 2 on the direction-distance coordinate plane.

Next, the basic idea of the OZT before coordinate transformation into the direction-distance coordinate is explained referring to FIG. 3, taking the target vessel represented by the position indication mark B in FIG. 2 as an example. In FIG. 3, the target vessel represented by the position indication mark B in FIG. 2 is shown as a target vessel B. The expected route of the target vessel B is also shown as the expected route β in FIG. 3.

In FIG. 3, it is assumed that the target vessel B is under way with maintaining the current course and speed along the expected route β. At this time, plural points selected on the expected route β of the target vessel at an interval are target positions β1, β2, . . . βn, respectively. Then, a calculator calculates estimated times at which the target vessel B may reach the target positions β1, β2, . . . βn, respectively, as the target vessel B sails along the expected route β with maintaining the current speed. On the other hand, the calculator calculates times at which the own vessel 2 may reach the target positions β1, β2, . . . βn, respectively, when the own vessel 2 sails with maintaining the current speed toward the target positions β1, β2, . . . βn along the expected route β by selecting the most direct expected route r1, r2, . . . rn.

Next, also in FIG. 3, probability that the estimated times at which the target vessel B reaches the target positions β1, β2, . . . βn, respectively, as the target vessel B sails along the expected route β with maintaining the current speed coincides with the times at which the own vessel 2 reaches the target positions β1, β2, . . . βn, respectively, when the own vessel 2 sails with maintaining the current speed toward the target positions β1, β2, . . . βn by selecting the most direct expected route r1, r2, . . . rn is calculated by a virtual reach time consistency probability calculator. Based on the result of the calculation, at the target position whose calculated virtual reach time consistency probability is equal to or more than a predetermined value, for example, at the target position β5, β6, . . . β10, obstacle zone indication circles P having a arbitrarily set radius centering the target positions β5, β6, . . . β10 are drawn.

FIG. 4 displays the obstacle zone indication circles P as shown in FIG. 3 over the display screen 1 of FIG. 2. In FIG. 4, the obstacle zone indication circles P are displayed after the coordinate transformation into the direction-distance coordinate. Accordingly, the obstacle zone indication circles P at the expected routes β and δ are shown in a tilted oblate shapes partially overlapped each other. For example, the obstacle zone indication circles P on the expected route β are displayed in a group as an OZT display area PB, and the obstacle zone indication circles P on the expected route δ are displayed in a group as an OZT display area PD.

In FIG. 4, the OZT display areas PB and PD may be selectively displayed overlaid with the direction-distance coordinate plane of the display screen 1, individually or simultaneously, according to a screen operation. By displaying the OZT display areas PB and PD overlaid with the display screen 1, it is possible to prevent the own vessel 2 from interfering a target vessel promptly without fail, as well as to approach a desired target vessel in the shortest time.

The calculator for calculating the OZT exemplified by the OZT display areas PB and PD as shown above, and the display unit that displays, on the display screen, the positional relation between the own vessel and the target vessel as well as the OZT calculated by the calculator exemplified by various coordinates shown on the display screen 1 are integrally controlled by an integrated controller for processing trial navigation. With this, it is possible to process calculation and display in a mutually cooperated manner.

Figure 5:
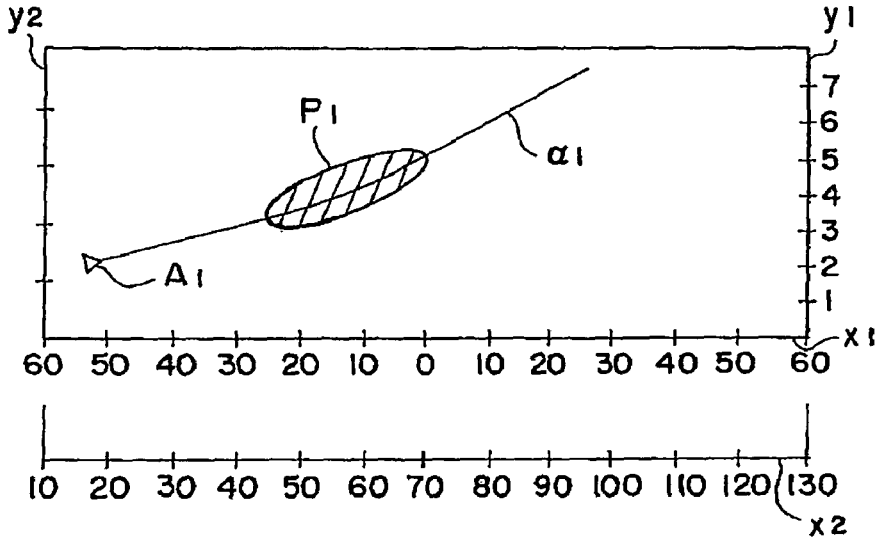
FIG. 5 illustrates another example of the display screen of a display unit in a vessel monitoring system according to the present invention.

FIG. 5 illustrates an example of the display screen of the display unit, in which relative values based on the heading of the own vessel are shown on a first horizontal axis x1, and absolute values based on the direction of the North Pole are shown on a second horizontal axis x2. Further in the display screen, a direct distance (e.g. mile) from the own vessel is shown on a first vertical axis y1, and time (e.g. minute) obtained from the distance from the own vessel divided by a value of the arbitrarily set speed of the own vessel is shown on a second vertical axis y2. With the display unit shown in FIG. 5, the time scale varies according to the value of the speed of the own vessel every time the speed of the own vessel is set again by trial-navigation operation, so that information relating to the target vessel A1, the expected route α1 of the target vessel A1, and the OZT P1 relating to the target vessel may be immediately read without fail. The display unit shown in FIG. 5 may also display a navigation mode that is selected and the speed of the own vessel that is provisionally set in the margin of the display screen.

Figure 6:
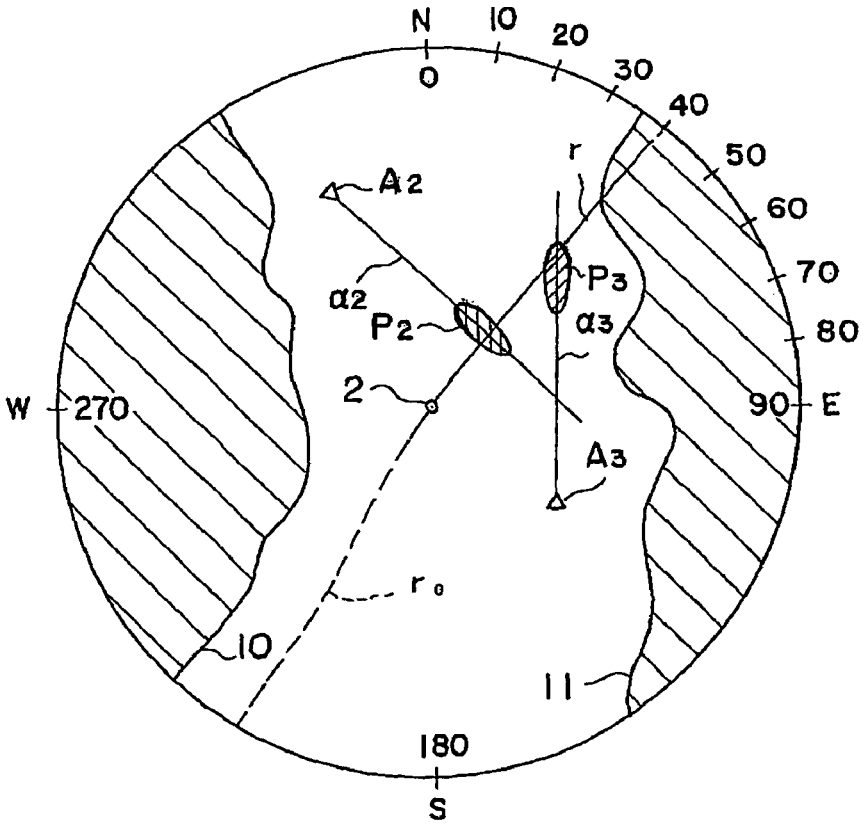
FIG. 6 illustrates yet another example of the display screen of the display unit in the vessel monitoring system according to the present invention.

FIG. 6 illustrates an example of the display screen when the display unit is configured to display the display screen including a track r0 and the expected route r of the own vessel 2 by absolute coordinates based on the Mercator projection or the zenithal projection. FIG. 6 shows target vessels A2 and A3 under way between land 10 and 11, an expected route α2 of the target vessel A2, an OZT P2 relating to the target vessel A2, an expected route α3 of the target vessel A3, and an OZT P3 relating to the target vessel A3.

Figure 7:
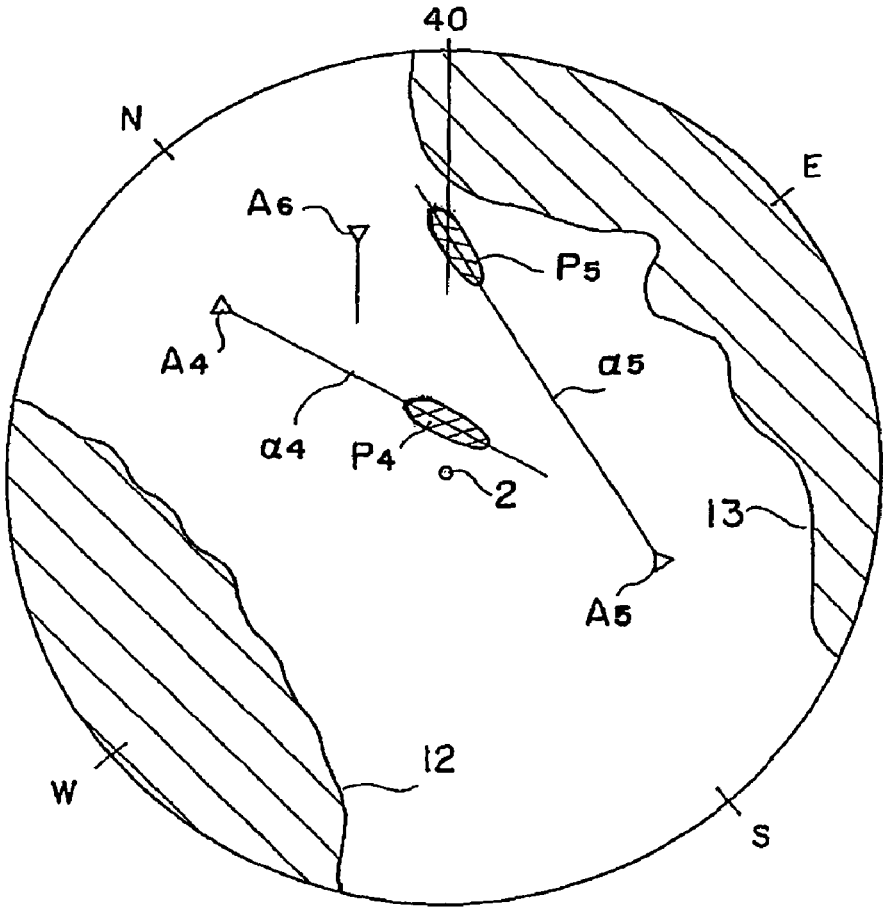
FIG. 7 illustrates yet another example of the display screen of the display unit in the vessel monitoring system according to the present invention.

FIG. 7 illustrates an example of the display screen when the display unit is configured to display the display screen by the zenithal projection with heading-up where the coordinate axes are fixed centering the own vessel 2 with the arbitrarily set heading of the own vessel upside. This may be arbitrarily selected out of three examples of the zenithal projection; the zenithal projection with north-up where the coordinate axes are fixed centering the own vessel 2 with the North Pole upside, the zenithal projection with course-up where the coordinate axes are fixed centering the own vessel 2 with the bearing (including provisionally set bearing) of the own vessel upside, and the zenithal projection with heading-up where the coordinate axes are fixed centering the own vessel 2 with the arbitrarily set heading of the own vessel upside.

In FIG. 7, the position of the own vessel 2 is fixed at the center of the circular display screen, and the arbitrarily set heading of the own vessel 2 is always upside of the display. Accordingly, the graduation of the coordinates varies according to the change in the heading of the own vessel 2. FIG. 7 shows target vessel A4, A5, A6 under way between 1 and 12 and 13, an expected route α4 of the target vessel A4, an OZT P4 relating to the target vessel A4, and expected route α5 of the target vessel A5, and an OZT P5 relating to the target vessel A5.

Figure 8:
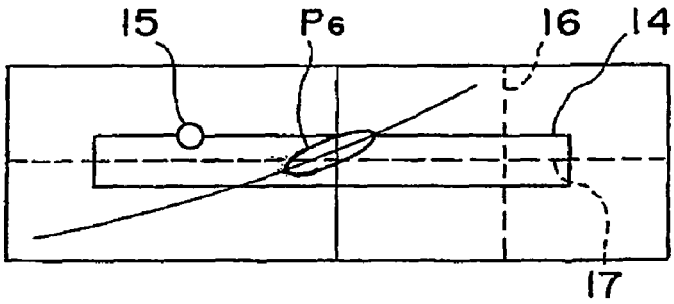
FIG. 8 illustrates yet another example of the display screen of the display unit in the vessel monitoring system according to the present invention.

FIG. 8 illustrates an example of the display screen when the display unit is configured to display the display screen overlaid with a watch and alarm area 14, a position and a range of which may be set arbitrarily, and an alarm generation unit immediately generates an alarm when at least one of a radar image 15 and an OZT P6 overlaps with the watch and alarm area 14. The display screen in FIG. 8 is shown by the direction-distance coordinate, and a direction indication mark 16 and a distance indication mark 17 may be movably displayed over the display screen according to a screen operation, so that the direction of and the distance to the radar image 15 may be determined.

Figure 9:
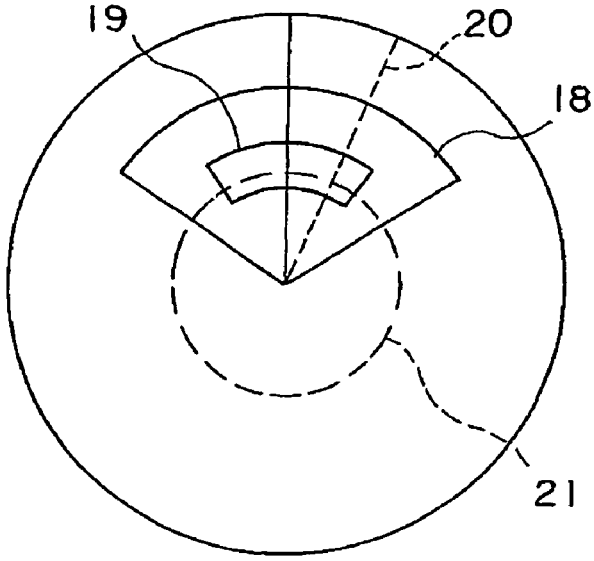
FIG. 9 illustrates yet another example of the display screen of the display unit in the vessel monitoring system according to the present invention.

FIG. 9 illustrates an example of the display screen when the display unit is configured to display an OZT display area 18 in the display screen overlaid with a watch and alarm area 19, a position and a range of which may be set arbitrarily, and an alarm generation unit immediately generates an alarm when at least one of the radar image and the OZT overlaps with the watch and alarm area 19. The display screen in FIG. 9 is shown by the zenithal projection centering the own vessel, and a direction indication mark 20 and a distance indication mark 21 may be movably displayed over the display screen according to a screen operation, so that the direction of and the distance to the radar image may be determined.

Figure 10:
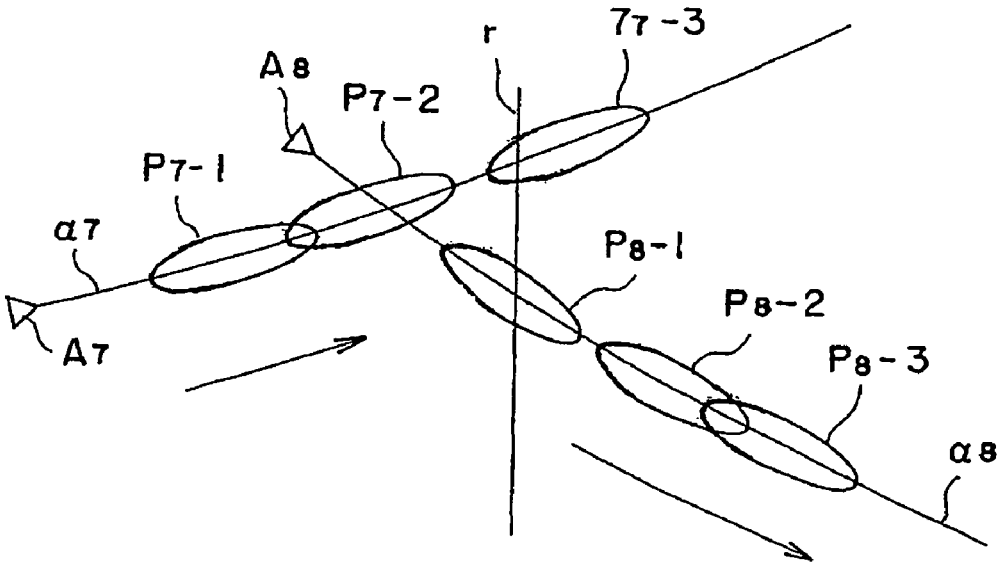
FIG. 10 illustrates yet another example of the display screen of the display unit in the vessel monitoring system according to the present invention.

FIG. 10 illustrates an example of the display screen when the display unit is configured to display an OZT in which the probability that the own vessel reaches the same location at the same time as the target vessel increases as the lapse of time in a reddish color, and an OZT in which the probability that the own vessel reaches the same location at the same time as the target vessel decreases as the lapse in a greenish color. FIG. 10 shows target vessels A7 and A8 in proximity to the expected route r of the own vessel. When an OZT P7 on an expected route α7 of the target vessel A7 is at P7-1, the OZT P7 is shown in yellow, for example. When the OZT P7 moves to the position of P7-2, the OZT P7 is shown in orange, for example, and when the OZT P7 moves to the position of P7-3, the OZT P7 is shown in red, for example. Further, an OZT P8 on an expected route α8 of the target vessel A8 is at P8-1, the OZT P8 is shown in red, for example, and when the OZT P8 moves to the position of P8-2, the OZT P8 changes its color to orange and then to yellow, and when the OZT P8 moves to the position of P8-3, the OZT P8 is shown in green, for example.

Other than the above display example, it is also possible to display in such a manner, for example, that an OZT is shown in red when the probability that the own vessel reaches the same location at the same time as the target vessel is not smaller than 50%, in orange when the probability is smaller than 50% and not smaller than 35%, in yellow when the probability is smaller than 35% and not smaller than 20%, and in green when the probability is smaller than 20%.

In the above embodiment, the identification of display by color difference has been described. However, the present invention is not limited to this, and it is also possible to identify the OZTs by shading of the same or different colors, by patterns inside the OZTs, or by the frequency of flashing of the OZTs, for example.

As an alternative embodiment, the system of the present invention may be so configured that, when the target vessel is selectively specified according to a screen operation, the calculator specifies the position at which the own vessel reaches at the same time as the target vessel with the highest probability, and the display unit displays the shortest distance to and the direction of the position specified by the calculator.

INDUSTRIAL APPLICABILITY

The present invention may be implemented in various embodiments within the scope of claims and a combination thereof. In particular, the present invention has significant industrial applicability as a vessel monitoring system for the safety of vessel navigation.

The invention claimed is:

1. A vessel monitoring system comprising:

a calculator for calculating an Obstacle Zone by Targets, based on a course and a speed of a target vessel and a course and a speed of an own vessel, for a case in which the course of the own vessel is changed to an arbitrary direction, the Obstacle Zone by Targets indicating a region which the own vessel reaches the same location at the same time as the target vessel with equal to or more than a predetermined probability;

a display unit for displaying positional relation between the own vessel and the target vessel, as well as the Obstacle Zone by Targets obtained by the calculation by the calculator; and an integrated controller for processing trial navigation that, in a trial navigation by provisionally setting a value of the speed of the own vessel arbitrarily, integrally controls mutually cooperated processing of the calculation by the calculator and the display by the display unit, so that the calculator calculates the Obstacle Zone by Targets corresponding to the arbitrarily and provisionally set value of the speed of the own vessel, and the display unit displays the result.

2. The vessel monitoring system according to claim 1, wherein the display unit is configured to selectively display an Obstacle Zone by Targets relating to a specified target vessel.

3. The vessel monitoring system according to claim 1, wherein the display unit is configured to display in direction-distance coordinates in which a horizontal axis is relative direction based on the heading of the own vessel, and a vertical axis is direct distance from the own vessel.

4. The vessel monitoring system according to claim 1, wherein the display unit is configured to display so that a horizontal axis is relative direction based on the heading of the own vessel, a first vertical axis is direct distance from the own vessel, a second vertical axis is time obtained from the distance from the own vessel divided by a value of the arbitrarily set speed of the own vessel, and a scale varies according to the value of the speed of the own vessel every time the speed of the own vessel is set again.

5. The vessel monitoring system according to claim 1, wherein the display unit is configured to display in absolute coordinates based on the Mercator projection including the course of the own vessel.

6. The vessel monitoring system according to claim 1, wherein the display unit is configured to display in absolute coordinates based on the zenithal projection including the course of the own vessel.

7. The vessel monitoring system according to claim 1, wherein the display unit is configured to display based on the zenithal projection arbitrarily selected from:

the zenithal projection with north-up where the coordinate axes are fixed centering the own vessel with the North Pole upside, the zenithal projection with course-up where the coordinate axes are fixed centering the own vessel with the bearing of the own vessel upside, and the zenithal projection with heading-up where the coordinate axes are fixed centering the own vessel with the arbitrarily set heading of the own vessel upside.

8. The vessel monitoring system according to claim 1, wherein the display unit is configured to display an expected course line indicating an expected course extended from a current position of the target vessel, thereby allowing immediate identification of correspondence between an encounter position and the target vessel which the own vessel is to encounter at the encounter position.

9. The vessel monitoring system according to one of claims 1 to 7, wherein the display unit is configured to display the display screen overlaid with a radar image of the own vessel after coordinate transformation so that the coordinates of the radar image match the coordinates in the display unit.

10. The vessel monitoring system according to claim 1, wherein the display unit is capable of displaying the display screen overlaid with a watch and alarm area, a position and a range thereof being set arbitrarily, and the display unit includes an alarm generation unit that immediately generates an alarm, when at least one of the radar image and the OZT overlaps with the watch and alarm area.

11. The vessel monitoring system according to claim 1, wherein when a target vessel is selectively specified according to a screen operation, the calculator calculates and specifies a position at which the own vessel reaches at the same time as the specified target vessel with a highest probability, and the display unit displays a shortest distance to and a direction of the position specified by the calculator from the own vessel.

12. The vessel monitoring system according to claim 1, wherein the display unit is configured to display by identifying Obstacle Zones by Targets according to degrees of the probability that the own vessel reaches the same location at the same time as the target vessel.

* * * * *